US006151752A

United States Patent [19]

Melzner et al.

[11] Patent Number: 6,151,752

[45] Date of Patent: Nov. 28, 2000

[54] VACUUM CLEANER HEAD

[75] Inventors: Edgar Melzner, Taufkirchen, Germany; Jürgen Jonischus, Romanshorn, Switzerland

[73] Assignee: Düpro AG, Switzerland

[21] Appl. No.: 09/330,952

[22] Filed: Jun. 11, 1999

[30] Foreign Application Priority Data

Jun. 12, 1998 [DE] Germany ..... 198 26 041

[51] Int. Cl.[7] ..... A47L 5/30

[52] U.S. Cl. ..... 15/387; 15/390

[58] Field of Search ..... 15/383, 387, 389, 15/390

[56] References Cited

U.S. PATENT DOCUMENTS

| | | | |
|---|---|---|---|
| 5,293,665 | 3/1994 | Worwag | 15/387 |
| 5,345,650 | 9/1994 | Downham et al. | 15/387 |
| 5,950,275 | 9/1999 | Worwag | 15/387 |

FOREIGN PATENT DOCUMENTS

| | | | |
|---|---|---|---|
| 0 338 780 A2 | 10/1989 | European Pat. Off. . | |
| 33 08 294 | 9/1983 | Germany . | |
| 3414862 | 11/1985 | Germany | 15/387 |
| 40 36 634 | 11/1990 | Germany . | |
| 42 29 030 | 9/1992 | Germany . | |
| 01221128 | 9/1989 | Japan . | |
| 09253010 | 9/1997 | Japan . | |

*Primary Examiner*—Terrence R. Till
*Attorney, Agent, or Firm*—Robert W. Becker & Associates

[57] ABSTRACT

A vacuum cleaner head has a housing having a turbine chamber and a connection tube connecting the turbine chamber to a suction aggregate of a vacuum cleaning machine. The housing has a suction opening and the turbine chamber has an inflow opening communicating with the suction opening. Air flow is sucked in by the suction aggregate through the suction opening and the inflow opening. A rotary roller brush is mounted in the housing close to the suction opening such that bristles of the roller brush project outwardly through the suction opening when the brush is in a lowest position. An air turbine is mounted in the turbine chamber such that the air turbine is acted upon by the air flow passing through the inflow opening. A device is provided for axially displacing the air turbine relative to the inflow opening when the power uptake of the roller brush is reduced.

17 Claims, 8 Drawing Sheets

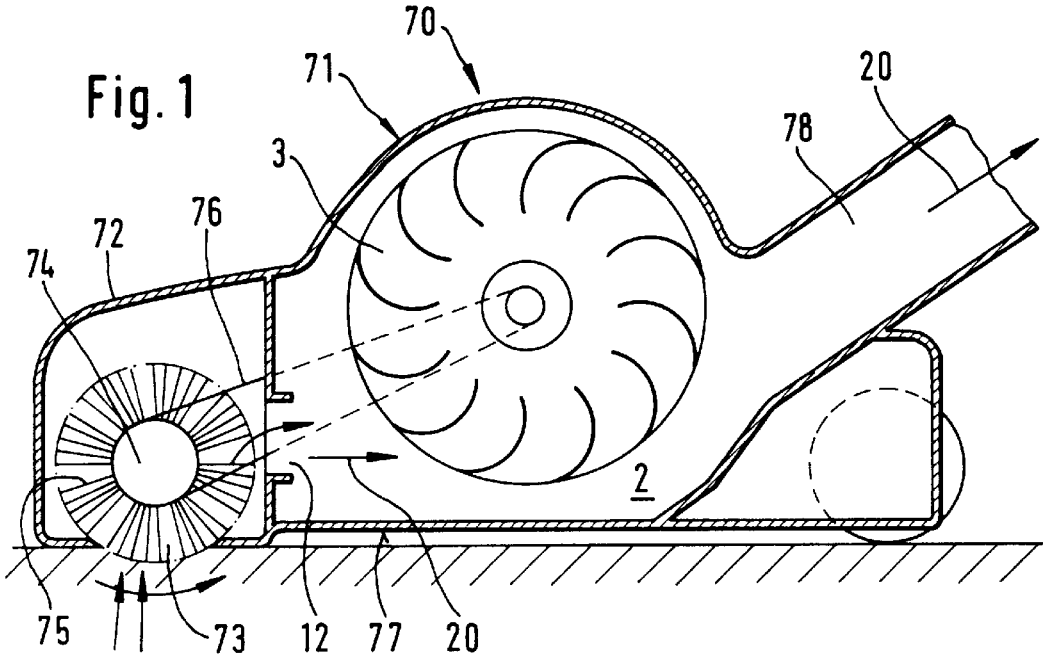
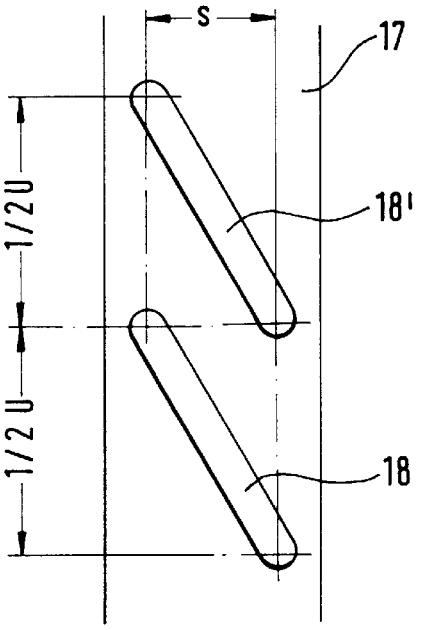
Fig. 3a
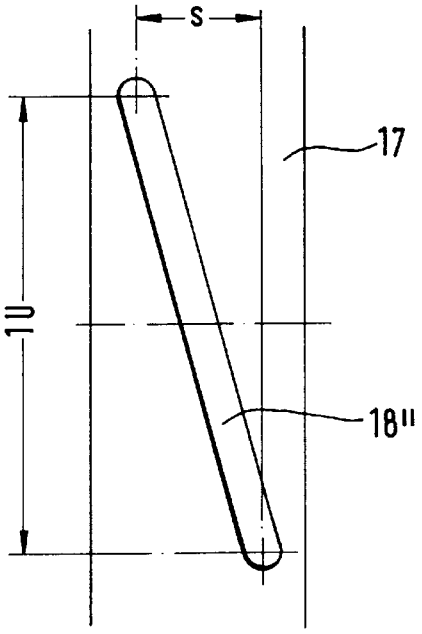
Fig. 3b

Fig. 6
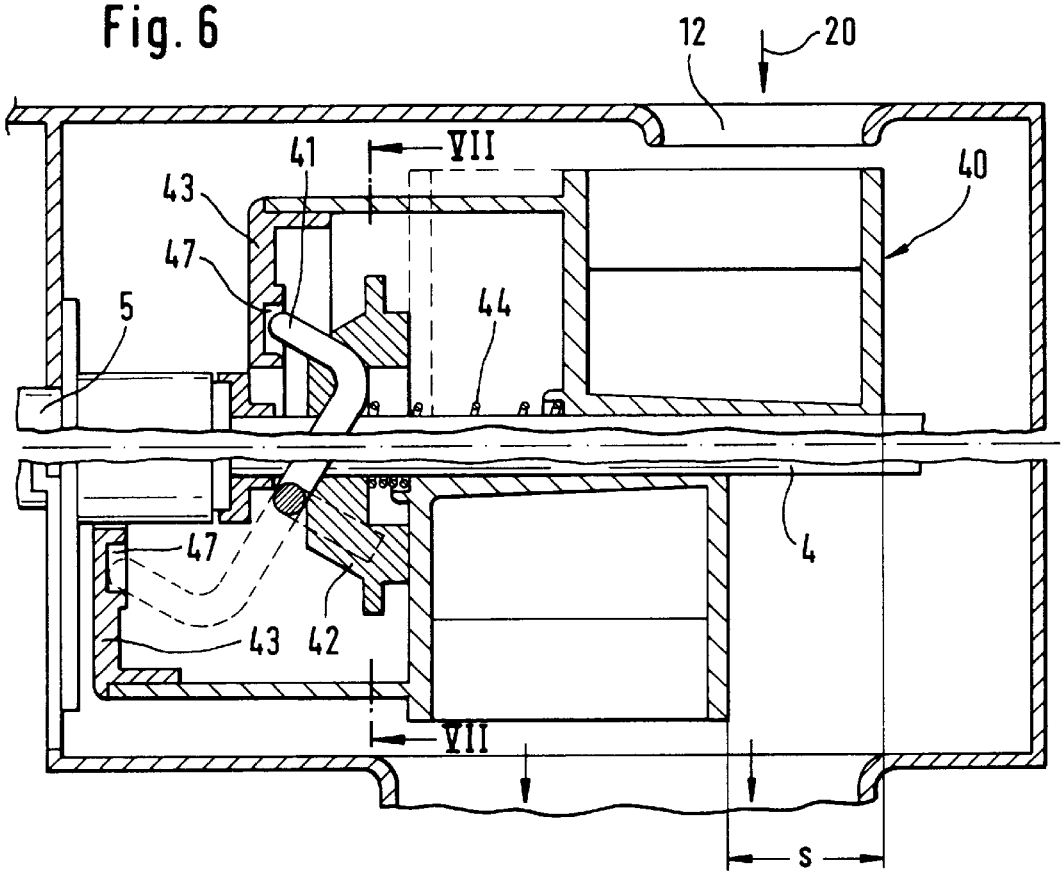
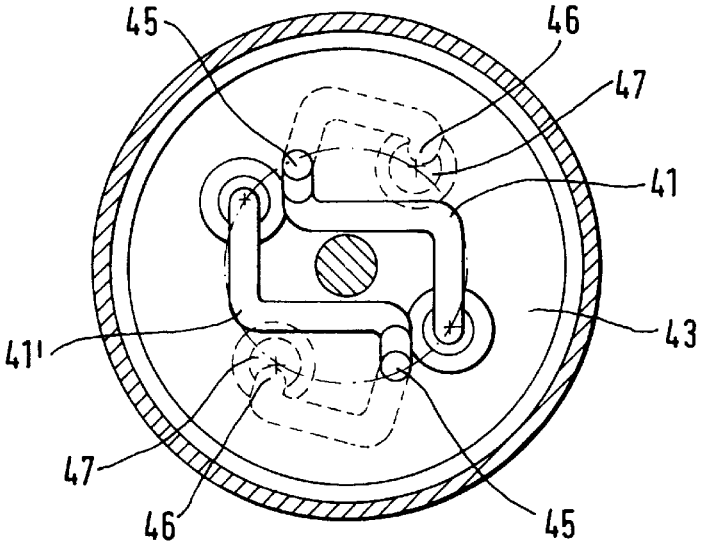
Fig. 7

Fig.13a
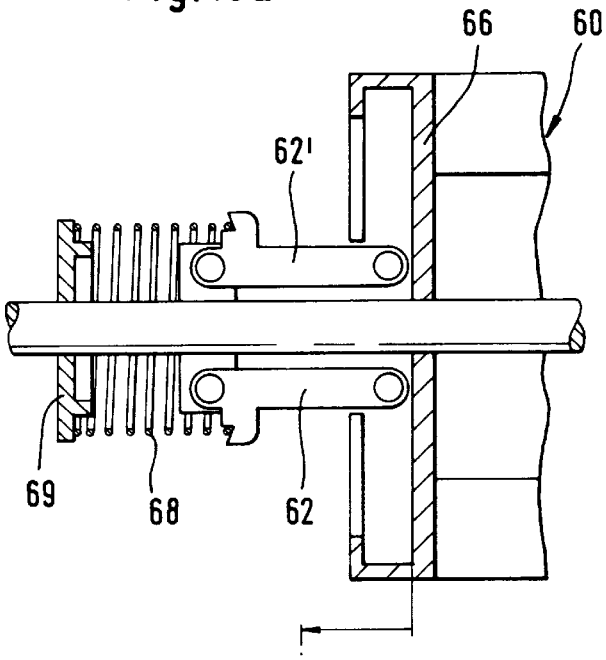
Fig.12a
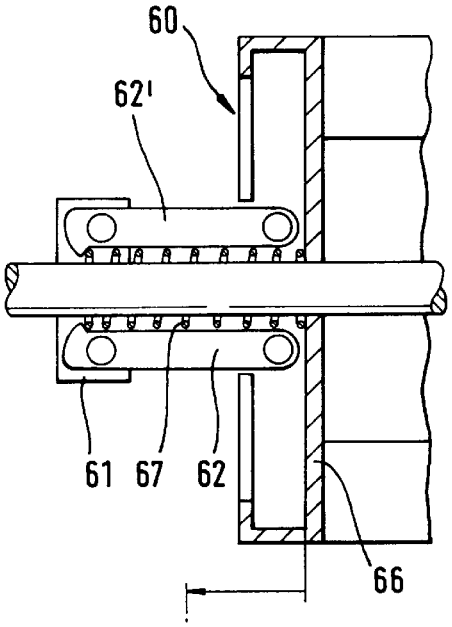
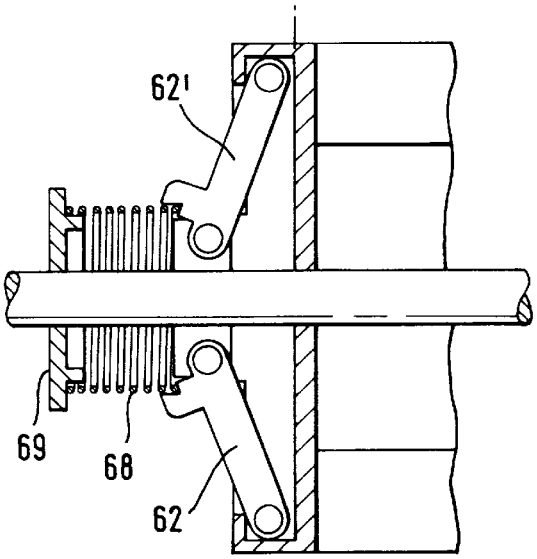
Fig.13b
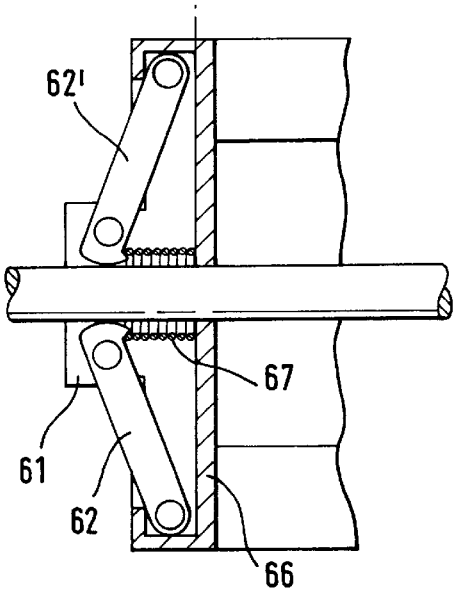
Fig.12b

VACUUM CLEANER HEAD

BACKGROUND OF THE INVENTION

The invention concerns a vacuum cleaner head for a vacuum cleaning machine with a housing having a connection tube to the suction aggregate of the vacuum cleaning machine in order to produce an airflow. A rotary roller brush is mounted in the housing close to its suction opening. The bristles of the roller brush project outwardly through the suction opening when the roller brush is in its lowest position. An air turbine is mounted in a turbine chamber of the housing in such a way that the air turbine can be acted upon by the flow of air drawn in, for which purpose an inflow opening is provided in the turbine chamber through which the flow of air drawn in can be directed onto the air turbine.

Vacuum cleaner heads usually comprise a housing with a connection tube to provide the airflow generated by the suction aggregate of a vacuum cleaning machine, and a rotary roller brush mounted in the housing close to its suction opening. In their lowest position the bristles of the roller brush project outwards through the suction opening and can therefore brush the surface beneath, which is to be vacuum cleaned. The roller brush is often driven by an air turbine acted upon by the flow of air drawn in.

Owing to their simple structure, air turbines are often used in central exhaust units and in machines for commercial cleaning, since such vacuum devices have powerful fans. Because of the high drive power, such vacuum cleaning machines present an accident risk to the person operating the machine or to people nearby, which should not be underestimated. When the vacuum brush is lifted clear of the surface being cleaned while the suction unit is still operating, the suction opening with the rapidly rotating brush is exposed. Since there is no longer any load, the rotation speed of the turbine and, of course, that of the brush as well increases rapidly, and any contact with the brush can lead to injury.

In such vacuum cleaner heads there also generally occurs the problem that when the vacuum cleaner head is lifted clear of the surface being cleaned beneath it, the rotation speed of the roller brush increases since there is no longer any force on it. The rotation speed increase applies not only to the roller brush but also to the air turbine driving it, and this not only leads to considerable stressing of the turbine bearings but also greatly increases the level of noise emitted.

To avoid these disadvantages, in DE 33 08 294 A1 an arrangement with an alternative air path has already been proposed, which circumvents the turbine chamber in the manner of a bypass so that when the vacuum cleaner head is lifted clear of the carpet or the like, the alternative air path is automatically opened.

DE 40 36 634 A1 describes a dust-sucking mouthpiece which comprises a rotary roller brush. In this dust-sucking mouthpiece there is a braking device which acts on the roller brush or its drive system and which can be released from its braking position depending on whether or not the mouthpiece is resting on a surface to be cleaned.

From DE 42 29 030 A1 a vacuum cleaner head is known, which comprises a roller brush driven by an air turbine. To avoid a drastic increase in rotation speed when the roller brush is raised, a throttle element for the airflow drawn in is provided, which when the vacuum cleaner head is lifted clear of the surface being cleaned, throttles the airflow drawn in until the roller brush comes almost or completely to rest.

The objective of the present invention is to provide a vacuum cleaner head of the aforementioned kind, in which the turbine rotation speed can be adapted automatically to the power demand of the roller brush at any time.

SUMMARY OF THE INVENTION

According to the invention, means are provided whereby, when the power uptake of the roller brush is reduced, the air turbine is displaced relative to the inflow opening along the axial direction of the air turbine.

The essential advantages of the invention are that depending on the loading of the roller brush, the proportion of the airflow drawn in which acts upon the air turbine can be adjusted by relative displacement of the air turbine with respect to the air inflow opening, and the turbine rotation speed is therefore variable according to need and can, if necessary, be reduced to an idling speed.

A possible embodiment of the basic idea consists in providing the inlet opening in a displaceable panel. In such a design no measures concerning the air turbine itself are needed and it is only necessary to ensure that there is sufficient passage to allow the fraction of the airflow drawn in, which is to bypass the air turbine, to flow through.

According to a variant embodiment of the invention, the air turbine is positioned in the turbine chamber so that it can be axially displaced. For this, the turbine chamber is correspondingly dimensioned in the axial direction and the means for displacing the air turbine axially are preferably also located inside the turbine chamber. To achieve as exact an action upon and regulation of the air turbine as possible, it is appropriate for the inflow opening to be in the form of a nozzle.

The continuous adjustability of the air turbine displacement relative to the inflow opening makes possible an adapted power control whereby the rotation speed can be reduced until the air turbine is idling. The air turbine usually extends parallel to the roller brush, and is provided with a drive shaft which drives the roller brush by a toothed belt. For the axial displacement of the air turbine, it is appropriate that it comprises a turbine shaft coupled to a drive shaft for the roller brush in an axially displaceable way. For this, either the turbine shaft or the drive shaft is made hollow over a certain axial length, and a corresponding section of the respective other shaft fits into this hollow.

As means for the displacement of the air turbine centrifugal weights can be provided, which act upon the end face of the air turbine and move radially outwardly as a function of the increasing rotation speed. To return the centrifugal weights, springs are preferably provided, which either act directly between the centrifugal weights or push against a component with radial reference edges.

According to another embodiment of the invention, the means provided for displacing the air turbine are two masses that can rotate relative to one another and whose relative angular movement is converted into an axial displacement. These rotating masses may already be present in the form of the roller brush and drive shaft on the one hand and the air turbine with its turbine shaft on the other hand, but it can be advantageous to provide additional flywheel masses which not only evens out the rotation speeds during normal operation, but also cause, due to the different loading, a more rapid change of the relative rotation angle and, consequently, a more rapidly reacting axial displacement of the turbine as well.

To convert the relative rotation angle movement into a corresponding axial movement, at least one slideway and a radial projection engaging it can be provided between a shell section formed on the air turbine and an axially fixed component. For this, the slideway can be formed in the shell section and the projection can be formed as a pin which is pressed into an axially immobile (stationary or fixed) sleeve. On the other hand, it is also possible to form the slideway in the axially fixed sleeve, such that a projection positioned on the inside sleeve surface of the shell section of the air turbine engages the slideway. To produce a return movement when the force demand on the roller brush so requires, a spring is positioned between the axially fixed sleeve and the air turbine, the spring being preferably a tension and/or torque spring. Instead of the slideway arrangement with an engaging projection or pin, the axial movement can also be produced by two coaxial sleeves that engage one another and are positioned between the air turbine and the drive shaft so as to rest against one another on spiral radial surfaces. When a force difference in the circumferential direction is present, the spiral surfaces will slide over one another and so bring about an axial displacement.

To convert the relative rotation movement into an axial displacement, two stirrups can also be provided that are positioned between the masses, rotatable relative to one another, and rest against these masses. In this, the stirrups are preferably shaped so that a relative rotary movement of the bearing point is converted into a corresponding axial displacement of the bearing point. Preferably, the stirrups rest between two flywheel mass elements. The stirrups each rest with one end in a corresponding bore, while the other end can be accommodated in a recess.

BRIEF DESCRIPTION OF THE DRAWINGS

In the following, specific embodiments of the invention are explained with reference to the figures. It is shown in:

FIG. 1: a longitudinal section through a vacuum cleaner head;

FIGS. 3*a*, 3*b*: embodiments of slideways;

FIG. 6: an axial section through an air turbine with stirrups for generating of an axial movement;

FIG. 7: a radial section along the line VIII—VIII in FIG. 6;

FIGS. 12*a*, 12*b*: a variant of the embodiment of FIG. 11;

FIGS. 13*a*, 13*b*: a variant embodiment of FIG. 12.

DESCRIPTION OF THE PREFERRED EMBODIMENTS

Figure 2:
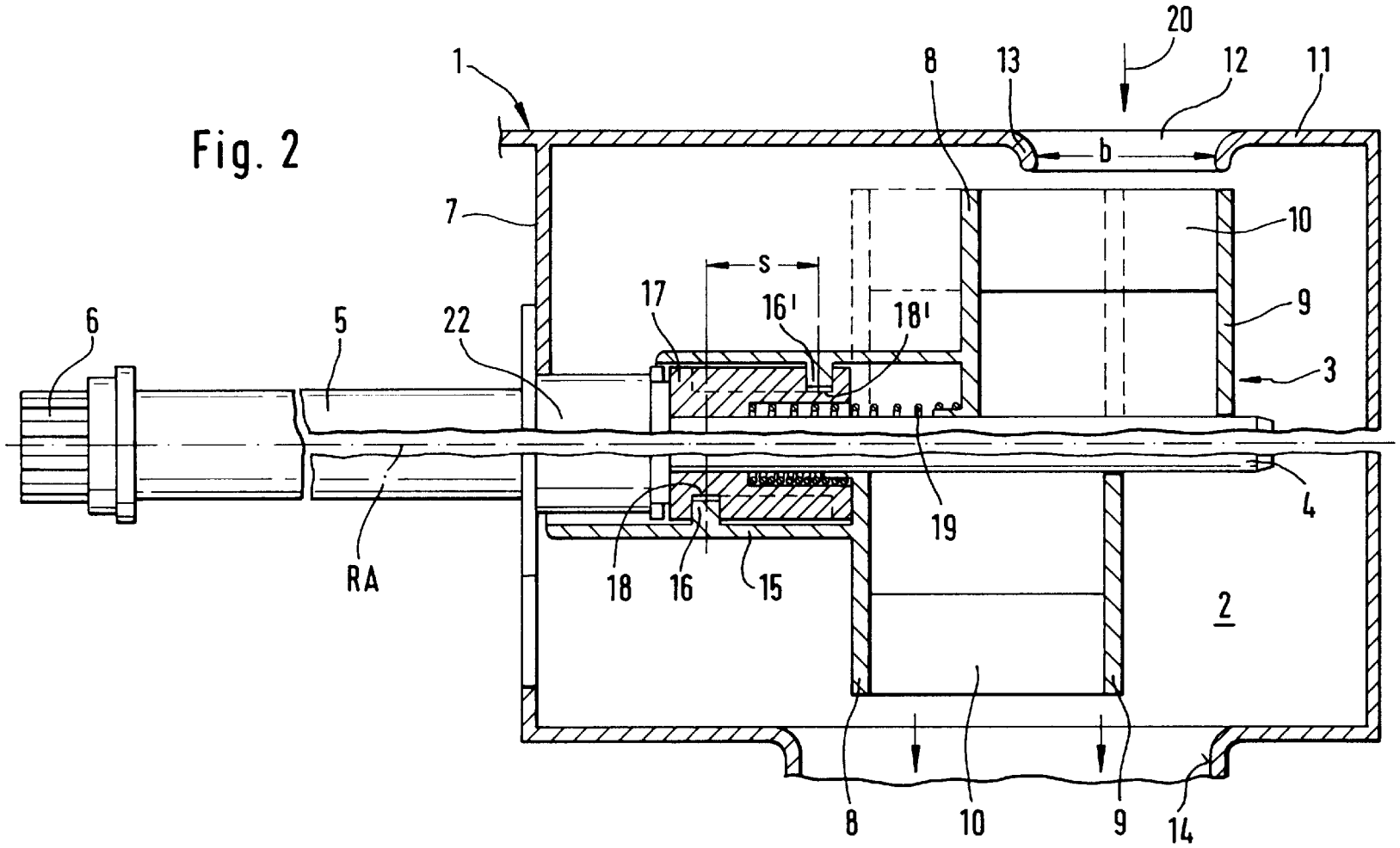
FIG. 2: an axial section through an air turbine that can be displaced within a turbine chamber.

FIG. 1 shows a schematic representation of a longitudinal section through a vacuum cleaner head 70, with a housing 71 whose forward part 72 has a suction opening 73 and whose middle section 77 comprises a turbine chamber 2 with an air turbine 3. The air turbine 3 serves to drive a roller brush 74, whose bristles 75 project through the suction opening 73 in their lowest position so that they can act on the underlying surface to be vacuum cleaned. The roller brush is coupled to the air turbine 3 via a toothed belt 76. The air turbine 3 is acted upon by an air flow 20 drawn in, which is produced by a vacuum aggregate (not shown) connected to a suction connector 78 and which enters the turbine chamber 2 through an inflow opening 12.

FIG. 2 shows an axial section through a turbine housing 1 in which a turbine chamber 2 is formed, and in which an air turbine 3 is mounted. The upper half of FIG. 2 shows the air turbine 3 in the full-load position, i.e. when a roller brush driven by the air turbine 3 is under maximum load, while the lower half of FIG. 2 shows the position of the air turbine 3 when it is idling, i.e., when the roller brush is under minimum load. Essentially, the air turbine 3 comprises two radial sidewalls 8 and 9 supported on a turbine shaft 4. Between the sidewalls 8 and 9 numerous turbine blades 10 are arranged. The turbine shaft 4 is connected by friction force to a drive shaft 5 at whose end a toothed belt drive wheel 6 is provided, so that the power produced by the air turbine 3 can be transferred to the roller brush by a toothed belt. The rotation axis of the turbine shaft 4 and the drive shaft 5 is indicated as RA.

The drive shaft 5 is mounted on a bearing element 22 attached to a sidewall 7 of the turbine housing 1. Wall 11 at the front of the turbine housing 1 has a nozzle 13 which forms an inflow opening 12 for an air flow 20 drawn in. The width of the inflow opening 12 is indicated as b. This air flow 20 drawn in acts upon the air turbine 3 to drive it and emerges from the turbine chamber 2 through an outflow opening 14. On the sidewall 8 of the air turbine 3 facing the drive shaft 5 a shell section 15 is provided, which extends coaxially with respect to the turbine shaft 4. This shell section 15 surrounds an axially fixed sleeve 17 which has two grooves 18, 18' in its sleeve surface. These grooves 18, 18' are engaged by projections 16, 16' directed radially inwardly. The projections 16, 16' are provided on the inside wall of the shell section 15. Between the sleeve 17 and the air turbine 3 a tension spring 19 is provided that is connected at one end to the sidewall 8 of the air turbine 3 and at the other end to a radial extension 21 of the sleeve 17. This tension spring 19 serves to produce a return movement so that, when the load on the roller brush decreases, the air turbine 3 will be brought back to the position shown in the lower half of FIG. 2.

FIGS. 3*a* and 3*b* show two variants of groove arrangements, in which the grooves 18, 18' or 18" serve as sideways for the projections 16, 16' which engage in the grooves 18, 18' or 18". FIGS. 3*a* and 3*b* show a developed view of the sleeve surface of the sleeve 17, such that in FIG. 3*a* there are two grooves 18, 18' running parallel to one another. The length of each of the two grooves 18, 18' and the angle they make relative to the rotation axis RA determine the turbine movement s, i.e., the maximum axial displacement of the turbine between its full-load and idling positions. Instead of two grooves 18, 18' there may also be a single groove 18", as shown in FIG. 3*b*. This groove 18" is inclined at a smaller angle and its length is therefore substantially greater. It is clear that with a design according to FIG. 3*b*, the rotation angle U of the relative movement required between the shell section 15 and the sleeve 17 to produce the full turbine movement s has to be twice as large as with the embodiment according to FIG. 3*a*.

When the vacuum cleaner is operating normally and the roller brush is fully loaded, the air turbine 3 is in the axial position shown in the upper half of FIG. 2, so that the blades 10 of the air turbine 3 are acted upon by the full flow 20 of air drawn in. If the vacuum cleaner head is lifted clear of the floor surface being cleaned, the load demand of the roller brush is rapidly reduced and at the same time the force of the tension spring 19 acts on the air turbine 3, so that there is an angular rotation movement relative to the drive shaft 5 and the sleeve 17 that rotates with it. This angular movement is converted to an axial movement by virtue of the projections 16, 16' engaged in the grooves 18, 18', so that the air turbine 3 is axially displaced by the distance s. The position of the air turbine 3 is then as shown in the lower half of FIG. 2, also indicated by the broken lines in the upper half of FIG. 2. When the vacuum cleaner is lowered and the roller brush therefore loaded again, the load demand is such that a force difference of the rotating masses of the roller brush and the drive shaft 5, on the one hand, and the air turbine 3 on the other hand, is produced. This rotates the masses relative to one another and so restores the turbine axially to its full-load position (upper half of FIG. 2).

Figure 4:
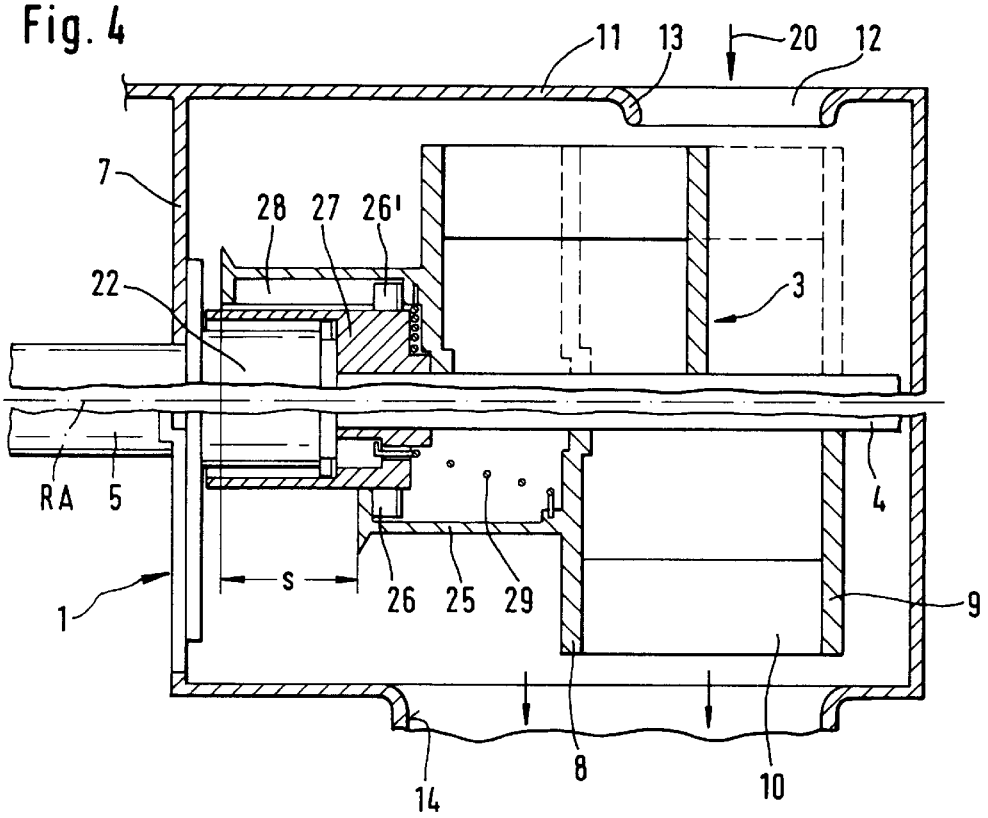
FIG. 4 a variant of FIG. 2.

FIG. 4 shows a variant of FIG. 2 with the same components identified by the same index numbers as in the earlier figure. In FIG. 4 there is a sleeve 27 attached to the bearing 22, into which are pressed two radially projecting pins 26, 26'. These pins 26, 26' engage in a slideway 28 formed within a shell section 26 formed on the side wall 8 of the air turbine 3. A spring 29 is arranged between the sleeve 27 and the air turbine 3. The spring 29 is a tension and torque spring. The mode of action of the variant in FIG. 4 corresponds to that of FIG. 2.

Figure 5:
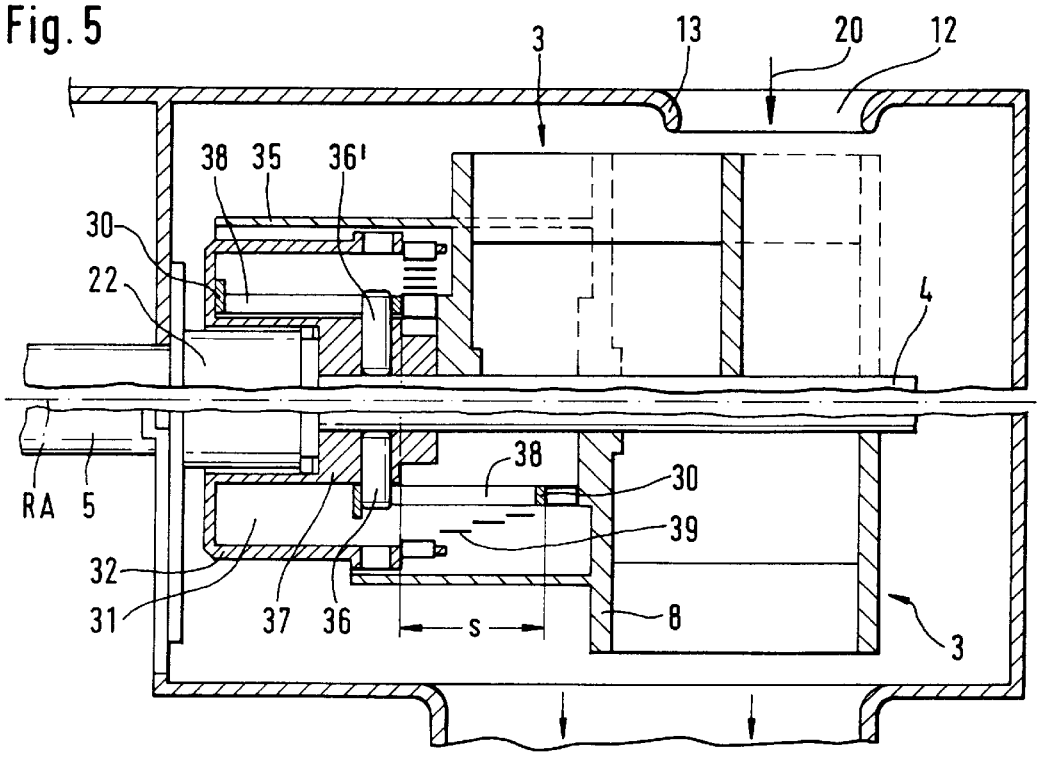
FIG. 5: another variant of FIG. 2.

FIG. 5 shows a variant of FIG. 4 in which a shell 30 forming the slideway is formed as a separate component. This separate shell 30 can be displaced within an annular space 31 of a shell 37 attached to the bearing 22. Into the shell 37 are pressed two radially projecting pins 36, 36', so that the projecting ends of the pins 36, 36' engage grooves 38, 38' formed in the shell 30 as slideways. To the foremost end of an outer ring 32 of the shell 37 which delimits the annular space 31, one end of a spring 39 is attached, which at its other end engages with the end of the shell 30 closest to the sidewall 8 of the air turbine 3. The spring 39 is designed as a flat-strip spring, and acts as a tension and torque spring. To prevent the penetration of dirt into the adjustment mechanism, a shell section 35 is provided on the side wall 8 of the air turbine 3, which surrounds the outer ring 32 of the shell 37 with a small clearance.

FIG. 6 shows a variant embodiment of an axially displaceable air turbine 40, with stirrups 41 provided for the axial displacement of the air turbine 40. One end of the stirrups 41 is held in a ring element 42 mounted on the turbine shaft 4 and the other end rests in recesses 47 formed in a radial wall 43 of the air turbine 40. Between the ring element 42 and the air turbine 40, a tension spring 44 is provided for the restoration of the air turbine to its idle position.

FIG. 7 shows a section along the line VIII—VIII in FIG. 6. This illustration clearly shows the shape of the stirrups 41. The ends 45 of the stirrups 41 form the bearing points in the ring element 42, and their other ends 46 rest in corresponding recesses 47 formed in the radial wall 43. In the full-load position indicated by solid lines, the respective bearing points of the same stirrup 41, 41' are a certain distance apart. When there is no load demand by the roller brush, the force of the tension spring 44 is active. With load demand by the roller brush, the rotary angular distance of the bearing points of the stirrup 41, 41' increases, so that the stirrup 41, 41' causes the bearing points formed by the recesses 47 to move in the rotational direction, so displacing the air turbine 40 to its full load position..

Figure 8A:
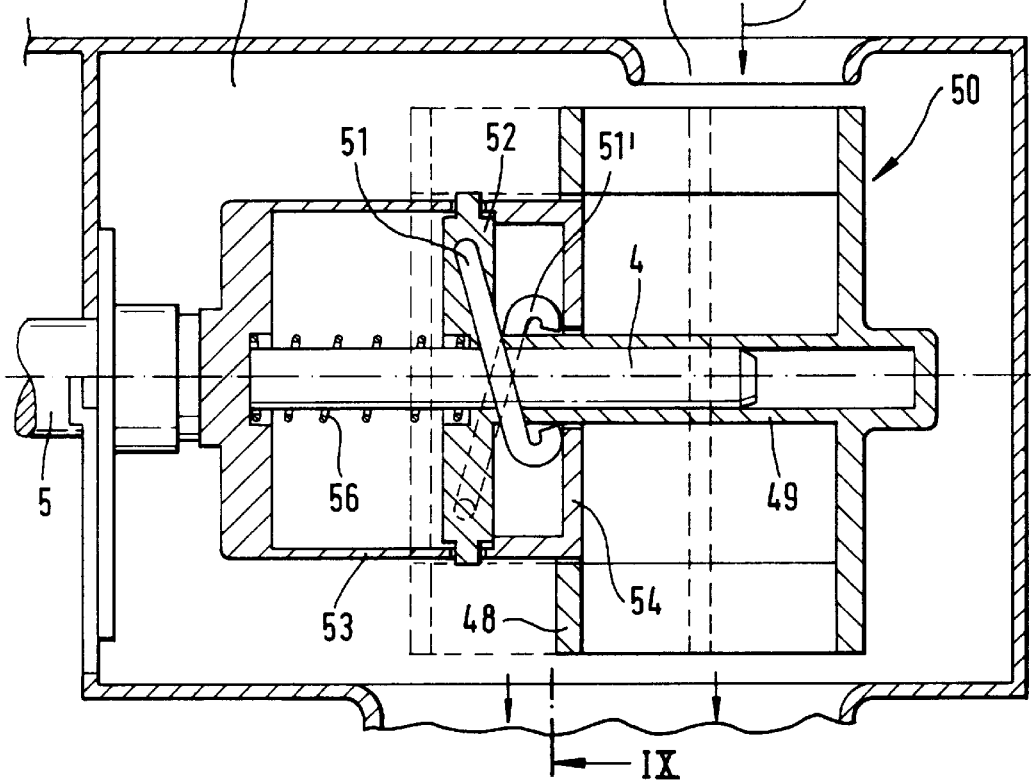
FIGS. 8*a*, 8*b*: axial sections through a variant embodiment with centrifugal weight elements.
Figure 8B:
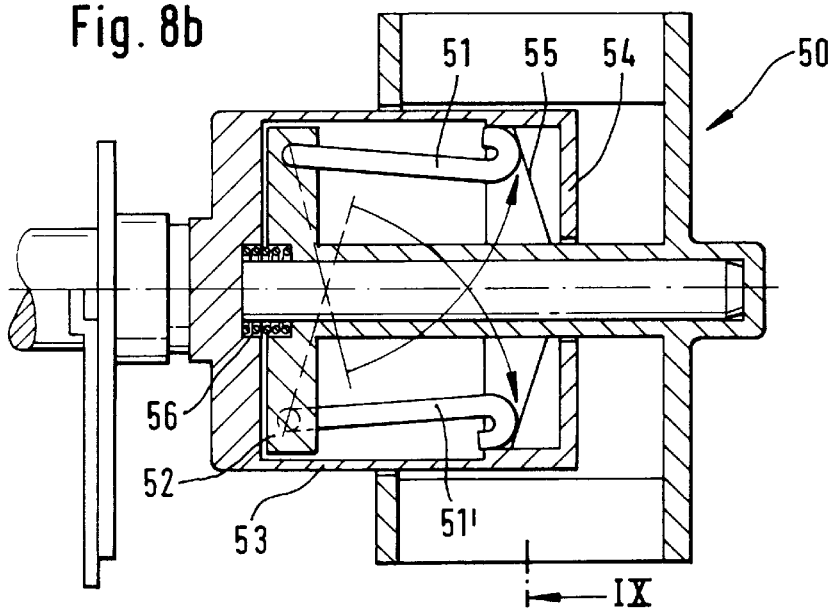

FIGS. 8*a* and 8*b* show an embodiment of an air turbine 50, in one case in the full-load position and in the other case idling. In this version a disc element 52 is located on a turbine hub 49. A sidewall 48 of the air turbine 50 is disc-shaped, so that the air turbine 50 can slide axially over a sleeve element 53. This sleeve element 53 is delimited by a radial wall 54 on the side facing the air turbine 50. The inner side of the wall 54 is provided with ramps 55 forming oblique surfaces. Centrifugal weights 51, 51' are mounted in the ring element 52. They can swivel about first ends and have opposed ends that rest against the oblique surfaces formed by the ramps 55. Between the disc element 52 and the sleeve element 53 is a compression spring 56, which serves to restore the air turbine 50 to its full-load position. The ramps 55 ensure that the force with which the centrifugal weights 51, 51' rest against their contact surfaces is not perpendicular to those surfaces, so that no blocking takes place.

Figure 9A:
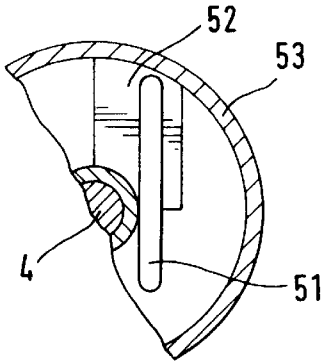
FIGS. 9*a*, 9*b*: a portion of an axial section along the line IX—IX in FIG. 8.
Figure 9B:
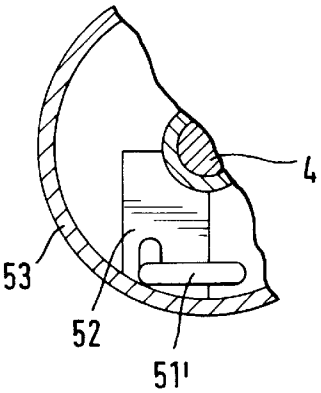

FIGS. 9*a* and 9*b* show a portion of a radial section along the line IX—IX in FIGS. 8*a* and 8*b* respectively. They illustrate the change in the position of the centrifugal weights 51, 51' resulting from the change in the rotation angle.

Figure 10:
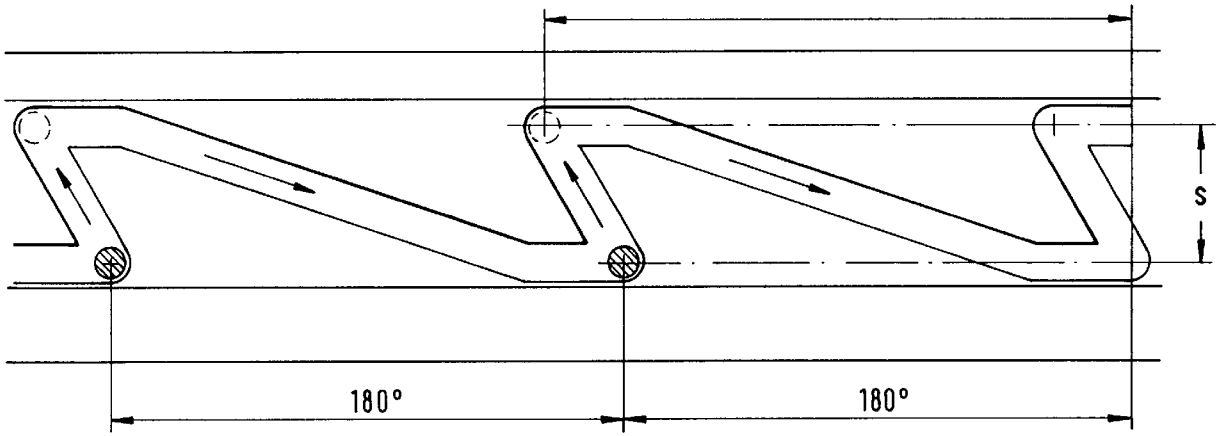
FIG. 10: a diagram of the dependence of the turbine displacement on the rotation angle setting.

FIG. 10 is a diagram showing the sequence of movements, i.e., the turbine displacement s that takes place as a result of the movement produced by centrifugal force, and the return movement caused by the braking effect when the roller brush makes contact with the carpet again.

Figure 11A:
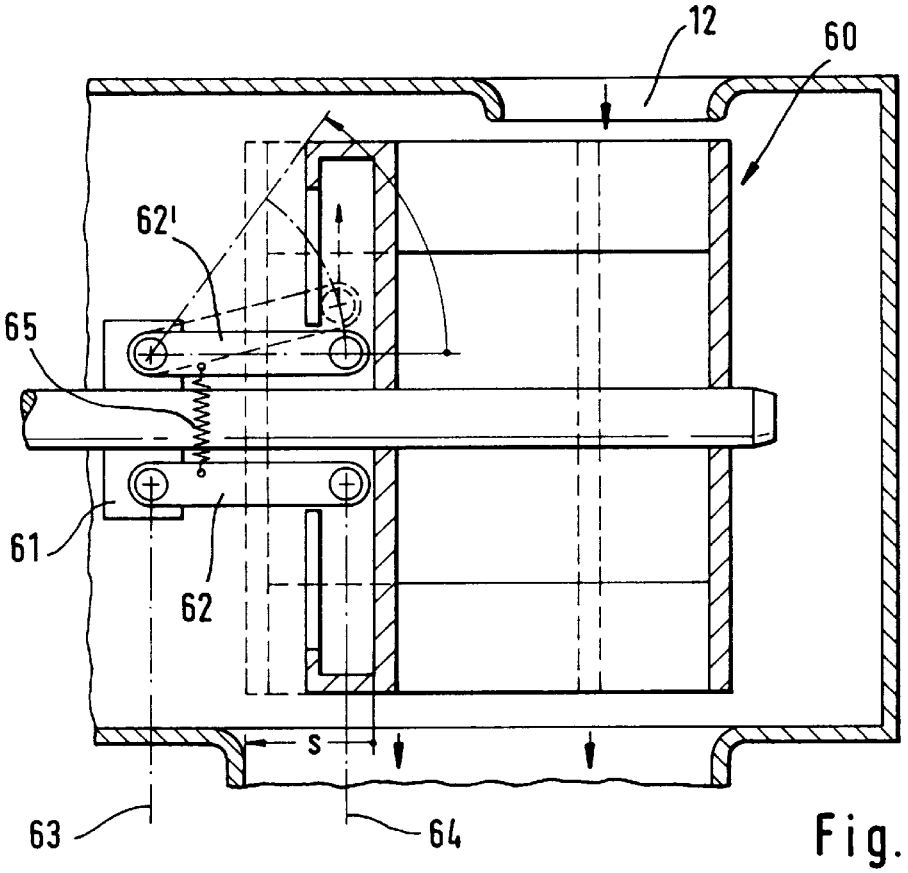
FIGS. 11*a*, 11*b*: axial sections through an air turbine with centrifugal force elements.
Figure 11B:
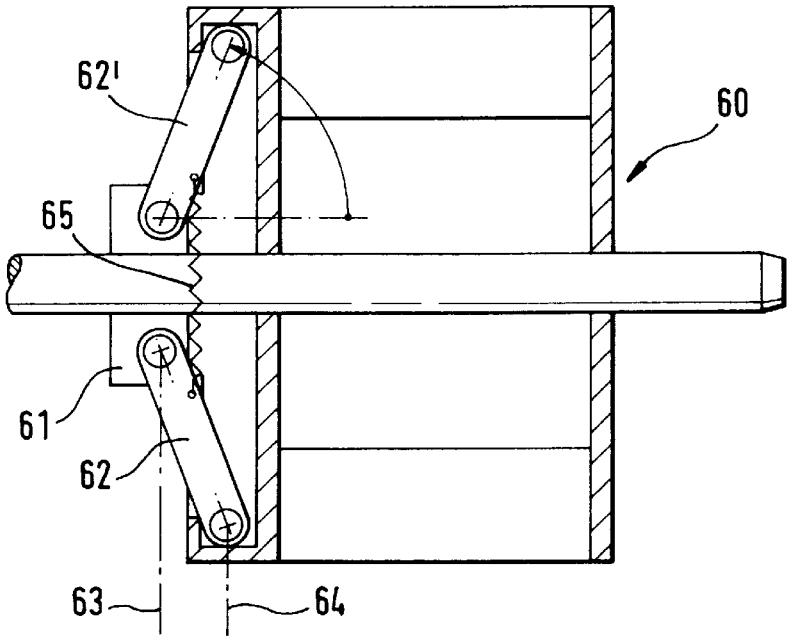

FIGS. 11*a* and 11*b* show an air turbine 60 which is again axially displaced by centrifugal weights. In this case two centrifugal weights 62, 62' are mounted to swivel on an element 61 attached so that it cannot move axially, the other end of the weights being engaged with the air turbine 60. When the rotation speed of the air turbine 60 increases, the ends of the centrifugal weights 62, 62' near the air turbine 60 swivel radially outwardly, and, in this way, bring about an approach of the radial planes 63 and 64, in which the swivel axes are located. To reverse the swivel movement when the centrifugal force decreases, a spring 65 is provided which acts directly between the two centrifugal weights 62, 62' since its ends are attached respectively to the weights 62, 62'.

FIGS. 12*a* and 12*b* show a variant embodiment of FIGS. 11*a* and 11*b*, in which a compression spring 67 is positioned between the ends attached to the element 61 and a radial wall 66 of the air turbine 60.

FIGS. 13*a* and 13*b* show another variant of an adjustment device comprising centrifugal weights 62, 62', in which a spring element 68 which provides the restoring force rests against an axially fixed plate 69.

The specification incorporates by reference the disclosure of German priority document 198 26 041.5 of Jun. 12, 1998.

The present invention is, of course, in no way restricted to the specific disclosure of the specification and drawings, but also encompasses any modifications within the scope of the appended claims.

What is claimed is:

1. A vacuum cleaner head (70) comprising:

a housing (71) having a turbine chamber (2) and a connection tube (78) connecting said turbine chamber (2) to a suction aggregate of a vacuum cleaning machine;

said housing (71) having a suction opening (73) and said turbine chamber (2) having an inflow opening (12) communicating with said suction opening (73), wherein air flow is sucked in by the suction aggregate through said suction opening (73) and said inflow opening (12);

a rotary roller brush (74) mounted in said housing (71) close to said suction opening (73) such that bristles (75)

of said roller brush (74) project outwardly through said suction opening (73) when said brush is in a lowest position;

an air turbine (3, 40, 50, 60) mounted in said turbine chamber (2) such that said air turbine (3, 40, 50, 60) is acted upon by said air flow (20) passing through said inflow opening (12);

means for axially displacing said airturbine (3, 40, 50, 60) relative to said inflow opening (12) when the power uptake of said roller brush (74) is reduced.

2. A vacuum cleaner head according to claim 1, wherein said air turbine (3, 40, 50, 60) is positioned in said turbine chamber (2) so as to be axially displaceable.

3. A vacuum cleaner head according to claim 2, wherein said air turbine (50) has a ring (48) at one end and wherein said means for axially displacing is insertable into said air turbine (50) through an opening of said ring (48).

4. A vacuum cleaner head according to claim 1, wherein said turbine chamber (2) has a nozzle (13) and wherein said inflow opening (12) is formed inside said nozzle (13).

5. A vacuum cleaner head according to claim 1, wherein said air turbine (3, 40, 50, 60) is mounted on a turbine shaft (4) and wherein said roller brush (74) has a drive shaft (5), said turbine shaft (4) being coupled to said drive shaft (5) so that said turbine is axially movable relative to said drive shaft (5).

6. A vacuum cleaner head according to claim 1, wherein said means for displacing are centrifugal weights (51, 51', 62, 62') connected to said turbine shaft (4) and rotating together with said turbine shaft (4).

7. A vacuum cleaner head according to claim 6, wherein said centrifugal weights (51, 51') each have one end slidingly resting on an oblique surface (ramp 55).

8. A vacuum cleaner head according to claim 6, comprising a spring (56, 65, 67, 68) connected to said centrifugal weights (51, 51', 62, 62'), wherein said centrifugal weights (51, 51', 62, 62') swivel against the force of said spring (56, 65, 67, 68).

9. A vacuum cleaner head according to claim 1, wherein said means for displacing are two masses rotatable relative to one another, wherein a relative angular movement between said two masses is converted into an axial displacement of said air turbine.

10. A vacuum cleaner head according to claim 9, wherein said air turbine (3) has a shell section (15, 25, 35) and an axially fixed component (17, 27, 37), wherein said shell section (15, 25, 35) and said axially fixed component (17, 27, 37) are connected to one another by at least one slideway (18, 28, 38) and at least one radial projection (16, 26, 36) engaging said at least one slideway (18, 28, 38).

11. A vacuum cleaner head according to claim 10, wherein said axially fixed component is a sleeve (27), wherein said least one slideway (28) is provided in said shell section (25) and said at least one projection is a pin (26, 26') pressed into said sleeve (27).

12. A vacuum cleaner head according to claim 10, wherein said axially fixed component is a shell (17) and wherein said at least one slideway (18) is provided in said shell (17) and wherein said at least one projection (16, 16') is formed on an internal sleeve surface of said shell section (15).

13. A vacuum cleaner head according to claim 12, comprising a tension and/or torque spring (19, 29, 39) positioned between said shell section (15, 25, 35) and said axially fixed component (17, 27, 37).

14. A vacuum cleaner head according to claim 9, wherein said two masses are two coaxial sleeves having spiral radial surfaces engaging one another, wherein said two coaxial sleeves are positioned between said air turbine and said drive shaft.

15. A vacuum cleaner head according to claim 9, wherein at least two stirrups (41, 41'), each having a first end and a second end, are positioned between said two masses (42, 43), wherein said first ends engage one of said two masses and wherein said second ends engage the other of said two masses.

16. A vacuum cleaner head according to claim 15, wherein said stirrups (41, 41') are shaped such that a relative rotary movement of bearing points of each one of said stirrups (41, 41') is converted into a corresponding axial displacement of said bearing points.

17. A vacuum cleaner head according to claim 15, wherein said two masses are two flywheel mass elements.

* * * * *